US007312793B2

(12) United States Patent
Chida

(10) Patent No.: US 7,312,793 B2
(45) Date of Patent: Dec. 25, 2007

(54) LIQUID CRYSTAL DISPLAY CONTROLLER

(75) Inventor: Kazunori Chida, Ota (JP)

(73) Assignee: Sanyo Electric Co., Ltd., Osaka (JP)

( * ) Notice: Subject to any disclaimer, the term of this patent is extended or adjusted under 35 U.S.C. 154(b) by 657 days.

(21) Appl. No.: 10/933,781

(22) Filed: Sep. 3, 2004

(65) Prior Publication Data

US 2005/0052397 A1 Mar. 10, 2005

(30) Foreign Application Priority Data

Sep. 5, 2003 (JP) ..... 2003-313637

(51) Int. Cl.
*G09Q 5/00* (2006.01)

(52) U.S. Cl. ..... 345/213; 345/87; 345/204; 348/525; 348/540; 348/546

(58) Field of Classification Search ..... 345/87, 345/204, 213; 348/525, 540, 526
See application file for complete search history.

(56) References Cited

U.S. PATENT DOCUMENTS 4,769,704 A * 9/1988 Hirai et al. ..... 348/516
5,418,573 A * 5/1995 Basile et al. ..... 348/536
5,671,214 A * 9/1997 Tanaka ..... 370/218
6,049,358 A * 4/2000 Jun ..... 348/546
6,215,467 B1 * 4/2001 Suga et al. ..... 345/660
6,907,472 B2 * 6/2005 Mushkin et al. ..... 709/248
2003/0117390 A1 * 6/2003 Arai ..... 345/213

FOREIGN PATENT DOCUMENTS

JP 10-49057 2/1998

OTHER PUBLICATIONS

English Patent Abstract of 10-49057 from esp@cenet, published Feb. 20, 1998.

* cited by examiner

*Primary Examiner*—Richard Hjerpe
*Assistant Examiner*—Vincent E. Kovaick
(74) *Attorney, Agent, or Firm*—Osha Liang LLP

(57) ABSTRACT

In a liquid crystal television, a display controller prevents burning of a liquid crystal panel due to irregularity in a synchronization signal. A counter of a liquid crystal display controller detects a period of a horizontal synchronization signal and a vertical synchronization signal. A comparator compares a count value with a predetermined minimum value Min and maximum value Max. When the count value is out of a range, a synchronization pulse generator generates a synchronization pulse at a time when the period falls within a predetermined range. A selector outputs an input synchronization signal when the period is within the range and outputs the synchronization pulse obtained from the synchronization pulse generator when the period is out of the range.

17 Claims, 6 Drawing Sheets

LIQUID CRYSTAL DISPLAY CONTROLLER

CROSS-REFERENCE TO RELATED APPLICATIONS

The priority Japanese Patent Application Number 2003-313637 upon which this patent application is based is hereby incorporated by reference.

BACKGROUND OF THE INVENTION

1. Field of the Invention

The present invention relates to a liquid crystal display controller, and more particularly to processing during the occurrence of abnormal conditions in a synchronizing signal.

2. Description of the Related Art

A liquid crystal display panel (LCD panel) which has conventionally been used as a monitor for a personal computer (PC) is now, in a growing number of cases, used for a liquid crystal television capitalizing on its thin and light-weight features. As long as a LCD panel is used as a PC monitor, a relatively stable signal is input to the LCD panel. On the other hand, when the LCD panel is used as a liquid crystal television, an input signal becomes unstable during channel tuning, and reproduction, fast-forwarding, and rewinding of VTR.

FIG. 8 shows a structure of a typical liquid crystal television. The liquid crystal television comprises a TV tuner 10 for receiving a TV image signal, an RGB decoder 12 for extracting an R signal, a G signal, and a B signal from the TV image signal received, a scaler 14 for converting the number of horizontal pixels or the number of scanning lines in the TV image signal, and a panel module 16. The panel module 16 includes a LCD panel and a LCD controller for driving the LCD panel. The LCD controller includes a timing controller for controlling timing and a driver IC, and scans the LCD panel in synchronism with horizontal and vertical synchronization signals. The driver IC latches a digital image signal in one horizontal period into a latch circuit based on a latch signal STB from the timing controller, and after converting the digital image signal into an analog signal in a D/A converter, outputs the analog signal to a driver element for driving each pixel of the LCD panel. For example, digital image signal data of R, G, and B stored in a data register is transferred to and latched into the latch circuit at the rising edge of the latch signal STB, and then analog output is sent to and displayed on the LCD panel at the falling edge of STB.

The timing controller and the driver IC properly operate whenever a stable signal is supplied from the PC or the like, whereas the timing controller cannot properly operate to drive the LCD panel when an unstable signal is supplied, as is often the case in channel tuning, VTR reproduction, etc. Such improper driving of the LCD panel results in that the screen becomes full white (in the case of a normally-white screen) or full black (in the case of a normally-black screen). The state where an unstable signal, in particular, a signal in which periods of horizontal and vertical synchronization signals are abnormal, is supplied, thereby causing a LCD panel to become full white or full black is specifically referred to as "burning" in the specification of this application.

Such "burning" can be prevented by adding a circuit in which the periods of the horizontal and vertical synchronization signals to be supplied to the LCD controller are detected to correct a period which is found to be different from a normal period.

Japanese Patent Laid-Open Publication No. Hei 10-49057 describes technology of masking new input of a vertical synchronization signal when a period of the vertical synchronization signal is shorter than a predetermined period, and further describes the following technique. If new input of the vertical synchronization signal is not supplied over a predetermined length of time after the last input of the vertical synchronization signal, a preliminary pulse is generated with the period equal to that of the vertical synchronization signal in the immediately preceding frame, and if the period between the preliminary pulse and new input of the vertical synchronization signal immediately subsequent to the preliminary pulse is shorter than a predetermined period, the new input of the vertical synchronization signal is masked.

FIG. 9 shows a configuration of a vertical count-down circuit employing the above-described technology and FIG. 10 shows a timing chart for the circuit. Suppose that a signal including a period shorter than the normal period is input to an AND circuit 70 as a vertical synchronization signal. Further, assuming output of an OR circuit 73 to be shifted to an "L" state by the first pulse of the vertical synchronization signal shown in FIG. 10, a counter 74 outputs a count value read at that time to a delay inverter 77, and resets the count value to "0" to initiate count up operation. The delay inverter 77 changes the sign of the count value output from the counter 74 as well as delaying the count value by one frame, and then outputs resulting data to a counter 75. The counter 75 initiates its count up operation taking the data output from the delay inverter 77 as an initial value. When the count value of the counter 74 reaches or exceeds "480", a window signal for noise removal to be output from the counter 74 to the AND circuit 70 is set to an "H" state. Then, when the second pulse of the vertical synchronization signal is input, the counters 74 and 75 are reset in synchronism with falling of the pulse. If the period of the vertical synchronization signal is normal, the count value of the counter 74 reads "525" immediately before resetting. This value is output to the delay inverter 77 in which after delaying the count value by one frame, the sign of the value is reversed to read "−525", and then supplied from the delay inverter 77 to the counter 75. The counter 75 initiates its count up operation taking the value supplied from the delay inverter 77 as an initial value, and sets the output signal to be provided to the OR circuit 78 to an "L" state when the count value reaches "−2" or greater (−2, −1). If the count value reaches "−1", the output signal to be provided to the counter 76 is set to the "L" state and the count up operation is terminated. The counter 76 sets the output signal to the "H" state at the falling edge of the output signal from the counter 75 and initiates its count up operation from the initial value of "0". When the count value reaches "480", the counter 76 sets the output signal to "L" and terminates the count up operation. The output signal from the OR circuit 78 is changed to the "L" state when the output from the counter 75 and the output from the counter 76 both become "L" state. Here, suppose that the fourth pulse of the vertical synchronization signal is input. Because an interval between the third pulse and the fourth pulse is shorter than usual intervals, the fourth pulse will be input to the AND circuit 70 before the count value of the counter 74 reaches "480". In other words, the fourth pulse is input when the output of the counter 74 is in the "L" state, which results in the fourth pulse being masked by the AND circuit 70. Therefore, a signal corresponding to the fourth pulse would not be output from the OR circuit 78. The counter 76 executes its count up operation after being reset by the third pulse of the vertical synchronization signal, and sets the output signal to the "L" state when the count value reaches "480". On the other hand, the counter 75 counts up from "−525" which is the count value of the immediately preceding frame and imported into the counter 75 as the initial value, and sets the output to the OR circuit 78 to "L" state at a time of reading a value "−2". At this time, because the output signal from the counter 76 is already in the "L" state, the output from the OR circuit 78 is set to "L" state (in which the fourth pulse is output). Subsequently the fifth pulse of the vertical synchronization signal is input, which causes the AND circuit 70 to output a pulse because the output from the counter 74 to the AND circuit 70 is in the "H" state when the fifth pulse is input. As a result of output of the pulse, output of a differentiating circuit is set to the "L" state, and as a result the counters 74 and 75 are reset. At the moment of resetting, the output of the counter 75 is in an "L" state, whereas the output of the counter 76 is in an "H" state (because the count value of the counter 76 is smaller than "480"), which brings about no change in the output signal of the OR circuit 78 (the "H" state is maintained). When the sixth pulse of the vertical synchronization signal is subsequently input, the output of the OR circuit 73 is turned to the "L" state because the output of the counter 74 is already in the "H" state. Consequently, the counters 74 and 75 are reset. At the moment of resetting, because the output of the counter 76 has already been set to "L" state, the output of the OR circuit 78 is set to "L" state at the same timing of resetting the counter 75 (i.e. the fifth pulse is output).

In this manner, when the signal including a period which is shorter than the normal period is input, the signal is masked by the counter 74 and the AND circuit 70 to thereby make it possible to avoid feeding of an abnormal synchronization signal.

In the above-described technology, however, masking is executed to prevent an original synchronization signal being output immediately after count down output, while an original synchronization signal input after the expiration of the masking period is taken in and output without change. Therefore, the final period of the vertical synchronization signal will differ from the intrinsic period, which brings about difficulty in driving the LCD panel properly.

SUMMARY OF THE INVENTION

The present invention provides a liquid crystal display controller capable of properly driving an LCD panel by correcting a period of a synchronization signal.

The liquid crystal display controller of this invention comprises an input section for inputting a synchronization signal and a synchronization pulse signal generator which judges whether or not a period of an input synchronization signal is within a range between predetermined minimum and maximum values, generates a synchronization pulse signal, when the period of the input synchronization signal is not within the range, at a time when the period falls within the range, then outputs the synchronization pulse signal as a substitute for the input synchronization signal, and further generates and outputs the synchronization pulse signal, when a period between generation of the synchronization pulse signal and new input of the synchronization signal is not within the range, at a time identical to or different from the time of initial generation.

According to this invention, when the input synchronization signal does not have the period within the predetermined range, an alternative synchronization pulse is generated and output so as to make the period fall within the predetermined range. Further, an event of returning to the input synchronization signal is limited by a condition that the period from the synchronization pulse is within the predetermined range to prevent an abnormal period from occurring in the returning event. When the period between the synchronization pulse and the input synchronization signal is not within the predetermined range, instead of returning to the input synchronization signal, an alternative synchronization pulse is generated and output again at a time identical to or different from the time when the previous synchronization pulse was output as an alternative. As the time for generating and outputting the synchronization pulse, for example, it is possible to adopt the time of the minimum value Min which is a lower limit of the predetermined range and the time of the maximum value Max which is an upper limit of the predetermined range.

In an embodiment of this invention, the synchronization pulse signal generator generates and outputs the synchronization pulse signal, when the period of the input synchronization signal is not within the range, at a time when the period becomes the maximum value, and further generates and outputs the synchronization pulse signal again, when the period between the generated and output synchronization pulse signal and new input of the input synchronization signal is not within the range, at a time when the period becomes the maximum value.

Further, in another embodiment of this invention, the synchronization pulse signal generator generates and outputs the synchronization pulse signal, when the period is smaller than the minimum value, thereby going out of the range, at a time when the period becomes the minimum value, or when the period of the input synchronization signal is greater than the maximum value, thereby going out of the range, at a time when the period becomes the maximum value, and further generates and outputs the synchronization pulse signal, when the period from generation and output of the synchronization pulse signal to new input of the input synchronization signal is not within the range, at a time when the period becomes the maximum value.

In still another embodiment of this invention, when the number of times that the synchronizing pulse signal is successively generated and output at the time when the period between generation of the synchronization pulse signal and new input of the input synchronization signal becomes the maximum value reaches a predetermined value, the synchronization pulse signal generator generates and outputs the synchronization pulse signal after changing the time to the time when the period becomes the minimum value.

In a further embodiment of this invention, the synchronization pulse signal generator generates and outputs the synchronization pulse signal, when the period of the input synchronization signal is smaller than the minimum value, thereby going out of the range, at the time when the period becomes the minimum value, or when the period of the input synchronization signal is greater than the maximum value, thereby going out of the range, at the time when the period becomes the maximum value, and further generates and outputs the synchronization pulse signal again, when the period between the generated and output synchronization pulse signal and new input of the input synchronization signal is smaller than the minimum value, thereby going out of the range, at the time when the period becomes the minimum value, or when the period between the generated and output synchronization pulse signal and new input of the input synchronization signal is greater than the maximum value, thereby going out of the range, at the time when the period becomes the maximum value.

The present invention will be understood more clearly by referring to embodiments described below. However, the scope of this invention is not limited to the following embodiments.

DESCRIPTION OF THE PREFERRED EMBODIMENTS

Figure 1:
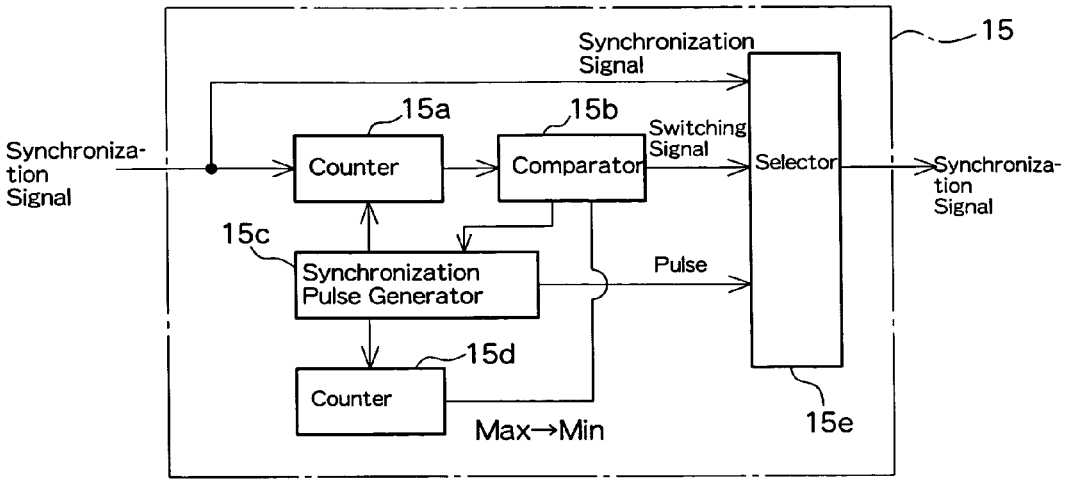
FIG. 1 shows a block diagram representing a configuration of a liquid crystal display controller.

Referring to the drawings, embodiments of this invention will be described below.

Figure 8:
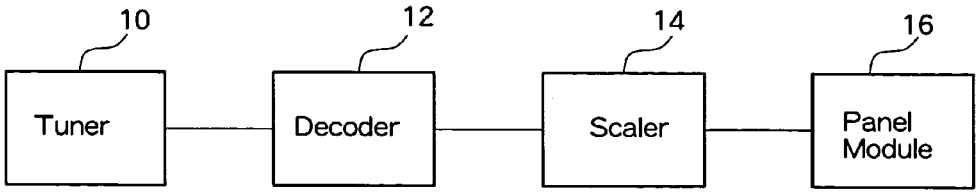
Fig. 8 RELATED ART
FIG. 8 shows an overall configuration of a liquid crystal television.
Figure 9:
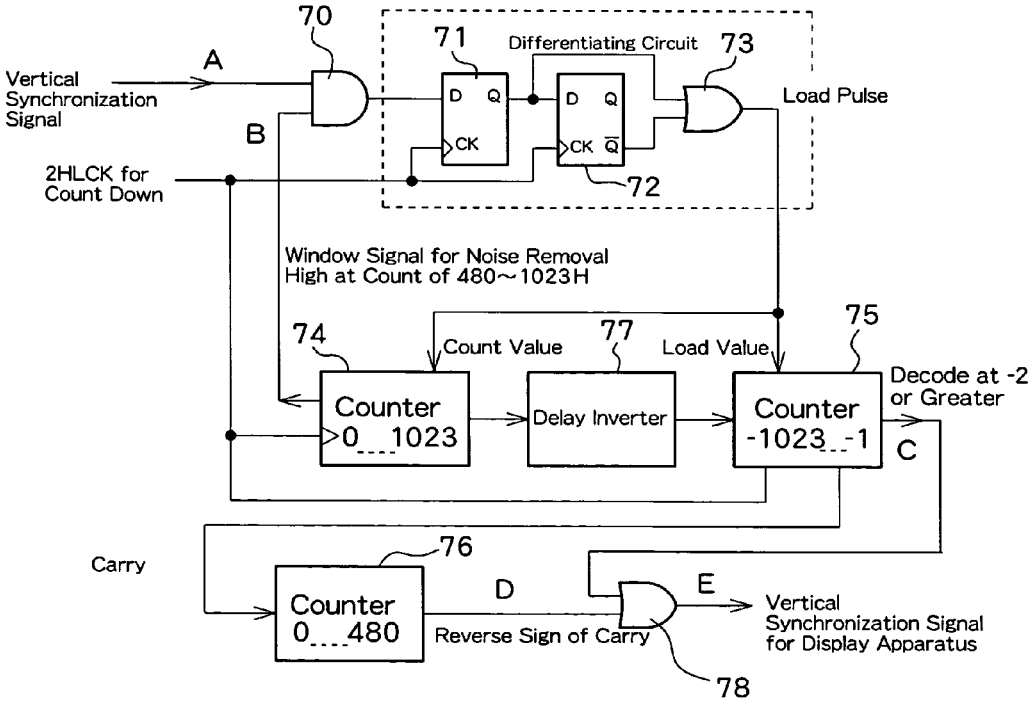
Fig. 9 RELATED ART
FIG. 9 shows a circuit diagram according to a related art.
Figure 10:
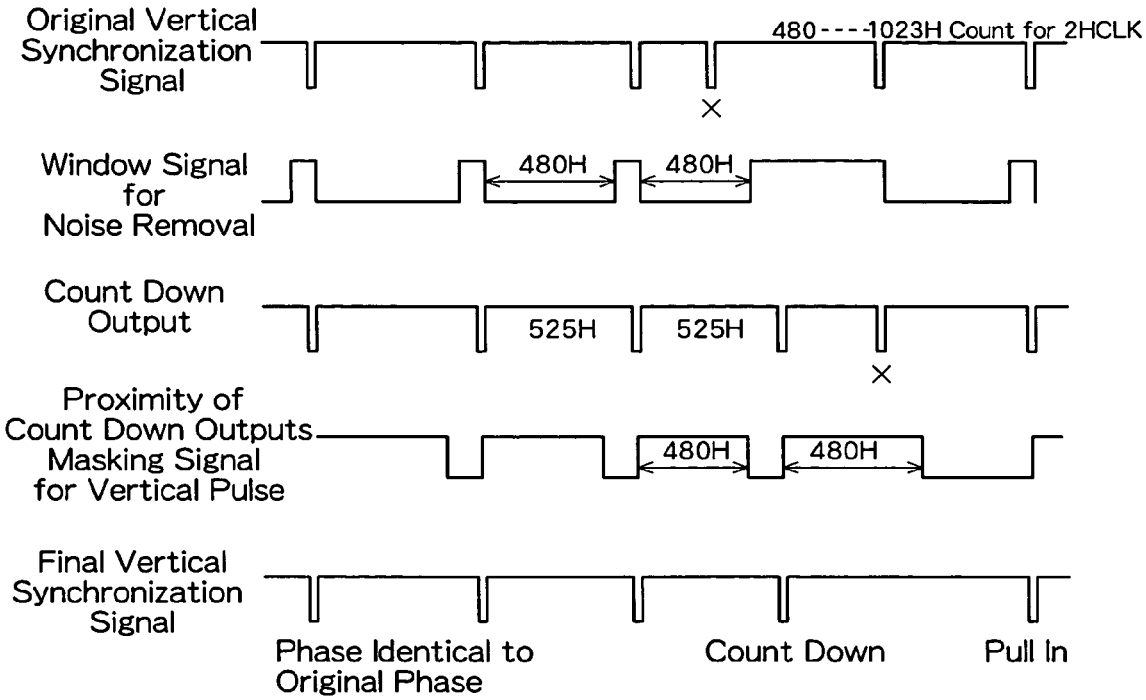
Fig. 10 RELATED ART
FIG. 10 shows a timing chart according to a related art.

FIG. 1 shows a circuit configuration of a liquid crystal display controller 15 according to this embodiment. This circuit is disposed, in the entire structure of a liquid crystal television illustrated in FIG. 8, between a scaler 14 and a panel module 16, in other words, at a position subsequent to the scaler 14.

The liquid crystal display controller 15 comprises a counter 15*a*, a comparator 15*b*, a synchronization pulse (or free-running pulse) generator 15*c*, a counter 15*d*, and a selector 15*e*.

The counter 15*a* receives horizontal and vertical synchronization signals from the previous configuration block and counts each period of the synchronization signals. The period of the horizontal synchronization signal corresponds to the number of horizontal pixels and the period of the vertical synchronization signal corresponds to the number of vertical lines. A count value in the counter 15*a* is supplied to the comparator 15*b*. The counter 15*a* also counts a period from generation of a synchronization pulse in the synchronization pulse generator 15*c* (which will be described later) to new input of a synchronization signal, and supplies a count value of the period to the comparator 15*b*.

The comparator 15*b* judges whether or not the count value supplied from the counter 15*a*, i.e. the period of the synchronization signal, lies within a predetermined range. More specifically, the period of the synchronization signal is compared with a predetermined minimum value Min to determine which is smaller, and compared with a predetermined maximum value Max to determine which is greater. The comparator 15*b* outputs a switching signal to the selector 15*e* based on results of comparing the period of the synchronization signal with the predetermined minimum value Min and the maximum value Max. Further, when the period of the synchronization signal is not within the predetermined range, i.e. when the period is smaller than the minimum value Min or greater than the maximum value Max, the comparator 15*b* outputs a pulse generation signal to the synchronization pulse generator 15*c*. The minimum value Min and the maximum value Max are specified according to a display resolution. For example, the minimum value Min may be set to 1050 and the maximum value Max may be set to 1800 for the horizontal synchronization signal, whereas the minimum value Min may be set to 780 and the maximum value Max may be set to 900 for the vertical synchronization signal.

Receiving the pulse generation signal from the comparator 15*b*, the synchronization pulse (or free-running pulse) generator 15*c* generates a synchronization pulse (or free-running pulse) and outputs the pulse to the selector 15*e*. It should be noted that the term "free-running pulse" is selected taking into account that the pulse is generated (free-running) in the controller 15 independently of the original synchronization signal. When a synchronization pulse is generated by the synchronization pulse generator 15*c*, the counter 15*d* is successively incremented. Further, the synchronization pulse generator 15*c* resets the count value of the counter 15*a* concurrently with generation of the synchronization pulse to allow the counter 15*c* to count a period from generation of the synchronization pulse to new input of a synchronization signal. Another counter independent of the counter 15*a* may be installed to count the period from generation of the synchronization pulse to new input of the synchronization signal. The count value is supplied to the comparator 15*b*.

The counter 15*d* counts the number of times that the synchronization pulse generator 15*c* generates a synchronization pulse. If the number of times of generating a synchronization pulse successively reaches a predetermined value, threshold values used for the comparison of magnitude executed by the comparator 15*b* are changed. For example, if the period from generation of the synchronize pulse to new input of the synchronization signal is not within a predetermined range, the comparator 15*b*, which usually causes the synchronization pulse generator 15*c* to output the synchronization pulse at the time when the period becomes the maximum value Max, changes the time of output from the maximum value Max to the minimum value Min.

The selector 15*e* receives the synchronization signal (the original synchronization signal) and the synchronization pulse from the synchronization pulse generator 15*c*, and selectively outputs either the signal or the pulse according to the switching signal from the comparator 15*b*. More specifically, when the period of the synchronization signal is within the predetermined range and when the period from generation of the synchronization pulse to next input of the synchronization signal is within the predetermined range, the selector 15*e* selects and outputs the synchronization signal (the original synchronization signal), whereas when the period of the synchronization signal is not within the predetermined range and when the period from generation of the synchronization pulse to next input of the synchronization signal is not within the predetermined range, the selector 15*e* selects and outputs the synchronization pulse (or the free-running pulse).

In such a configuration, whenever the synchronization signal having the normal period is input into the collector 15, the synchronization pulse generator 15*c* does not generate the synchronization pulse and the selector 15*e* always selects and outputs the synchronization signal. Accordingly, the input synchronization signal with its original waveform is output as it is from the controller 15.

On the other hand, when a synchronization signal having an unusual period, in other words a synchronization signal whose period is out of the predetermined range, is input into the controller 15, the synchronization pulse generator 15*c* is activated to generate a synchronization pulse and the selector 15*e* outputs the generated synchronization pulse as a substitute for the synchronization signal. Output of the generated synchronization pulse is successively repeated until the period between the generated synchronization pulse and the input synchronization signal falls within the predetermined range. Therefore, a synchronization signal having the period within the predetermined range is always output from the selector 15*c* and supplied to the subsequent panel module 16.

Figure 2:
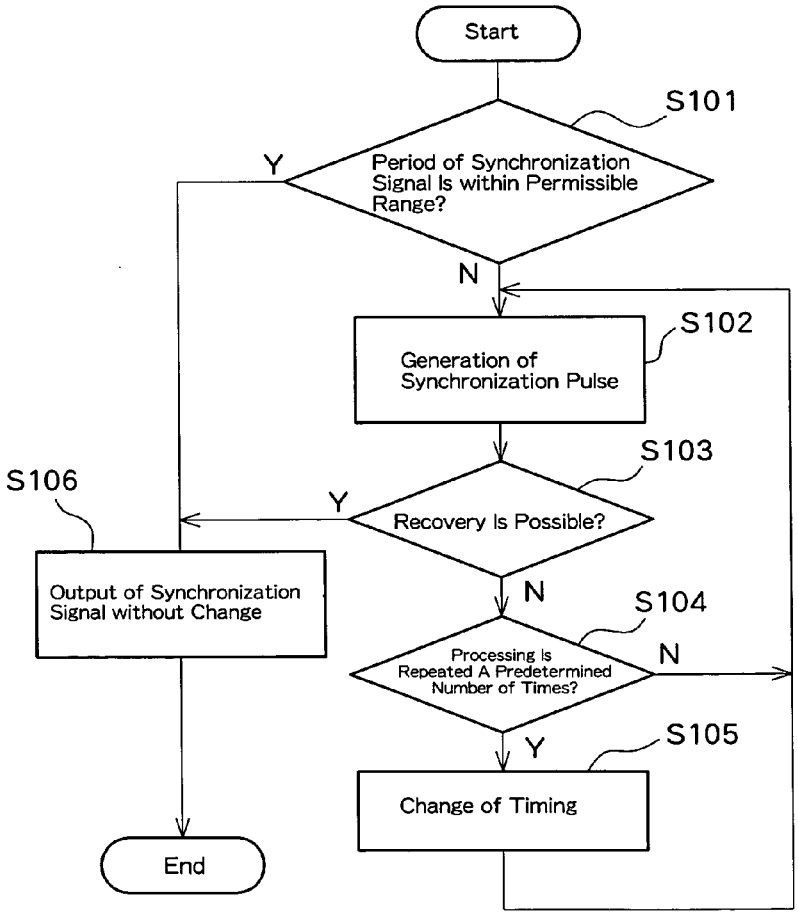
FIG. 2 shows a flowchart for basic processing according to an embodiment.

FIG. 2 shows a flowchart for basic operation of the controller 15. Firstly, it is judged in the comparator 15*b* whether or not the period of the synchronization signal is within the predetermined range, i.e. whether or not the period is greater than or equal to the minimum value Min and smaller than or equal to the maximum value Max (S101). When the period is judged to be within the range, the synchronization signal having been input is output without change (S106).

On the other hand, when the period of the synchronization signal is not within the range, i.e. the period is smaller than the minimum value Min or greater than the maximum value Max, the synchronization pulse generator 15*c* generates and outputs the synchronization pulse (or free-running pulse) (S102). Subsequent to generation and output of the synchronization pulse, it is judged whether or not it is possible to return to the input synchronization signal (the original synchronization signal) (S103). This judgment is made based on whether or not the period between the synchronization pulse and new input of the synchronization signal is within the predetermined range. When the period is within the range, it is judged to be possible to return, so that the synchronization signal having been input is output without change (S106). When the period is not within the range, it is judged to be impossible to return, so that output of the synchronization pulse is continued at a predetermined time. This time is the time when the period falls within the predetermined range, in other words, the time when the period lies somewhere between the minimum value Min and the maximum value Max. One example is the time when the period becomes the maximum value Max. In this case, the synchronization pulse is output so as to make the period equal to the maximum value Max. On the other hand, when the synchronization pulse is output because it is not possible to return to the input synchronization signal, it is further judged whether or not output of the synchronization pulse is successively repeated a predetermined number of times (S104). If the synchronization pulse is not output the predetermined number of times, output of the synchronization pulse is repeated at the same time, i.e. at the time when the period becomes the maximum value Max. On the other hand, when the number of generations and outputs of the synchronization pulse reaches the predetermined number of times, after changing the time of generating and outputting the synchronization pulse, in the above example, from the time when the period becomes the maximum value Max to the time when the period becomes the minimum value Min, the synchronization pulse is generated and output at the changed time (S105). The time is changed for the purpose of preventing return to the input synchronization signal being retarded by continuing generation of the synchronization pulse at the same time. More specifically, even if the period of the input synchronization signal recovers to the normal period, the synchronization pulse is continuously output unless the period between the synchronization pulse and the input synchronization signal is not within the predetermined range. As a result, the input synchronization signal is continuously blocked. In order to prevent such continuation of blocking of the input synchronization signal, the time is changed.

It should be noted that, as the time of outputting the synchronization pulse (or free-running pulse) when the period is not within the range, two different times are considered. That is, one is the time of initially outputting the synchronization pulse as a substitute for the input synchronization signal and the other is the time of continuously outputting the synchronization pulse because it is impossible to return from the synchronization pulse to the input synchronization signal. Both of the times may be specified to the same point in time or may be specified to different points in time. As the former example, output is always executed at the time when the period becomes the Max value. On the other hand, as the latter example, the time of initially outputting the synchronization pulse as a substitute for the input synchronization signal is specified to either a point in time when the period becomes the Min value or a point in time when the period becomes the Max value according to the length of the period, whereas the time of continuously outputting the synchronization pulse because it is impossible to return from the synchronization pulse to the input synchronization signal is always specified to the point in time when the period becomes the Max value. The time specified to either the point in time when the period becomes the Min value or the point in time when the period becomes the Max value according to the length of the period is, more specifically, implemented in such a manner that the synchronization pulse is output at the time when the period become the Min value in a case where the period is shorter than the value Mix, or the synchronization pulse is output at the time when the period becomes the Max value in a case where the period is longer than the value Max.

Figure 3:
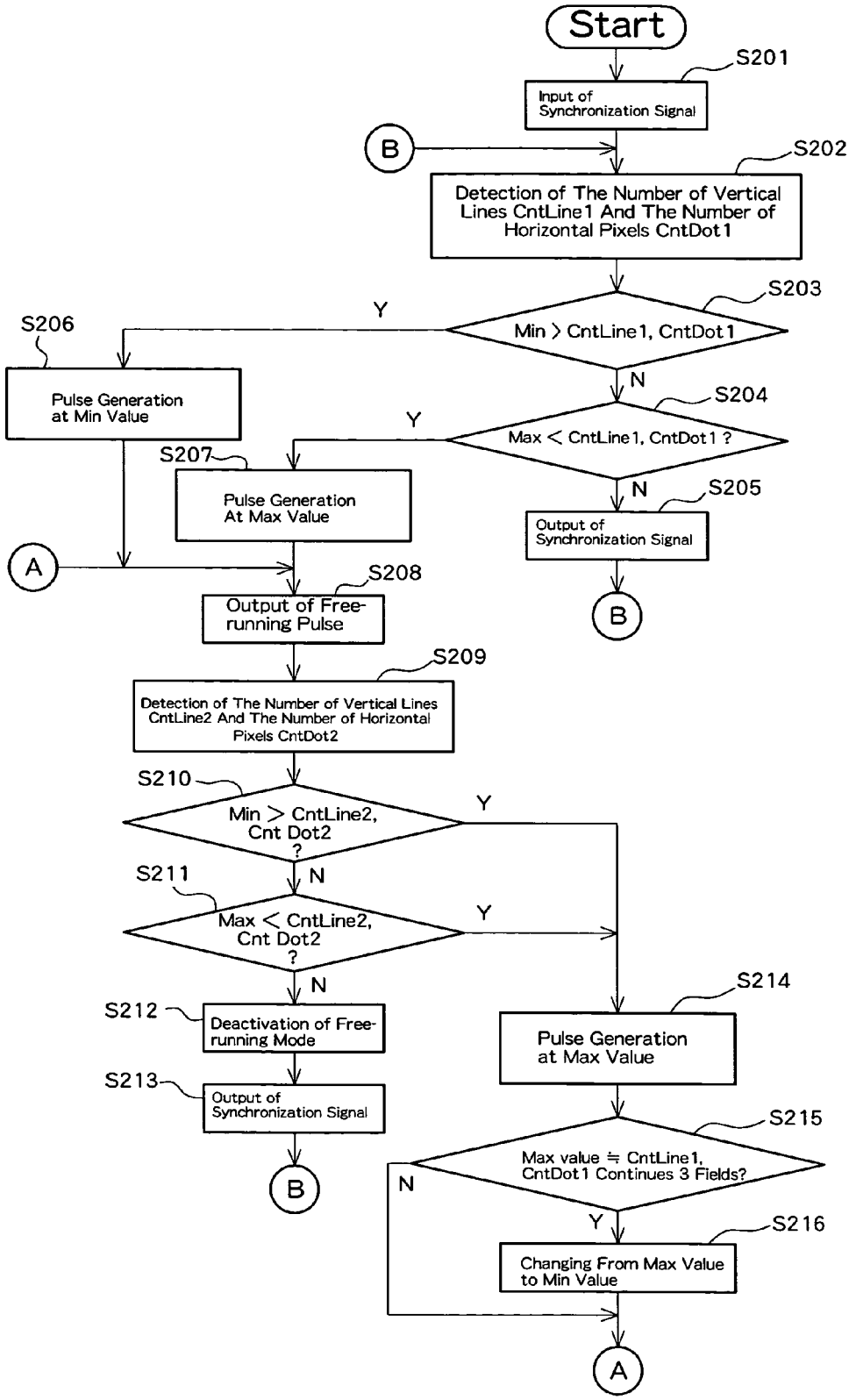
FIG. 3 shows a detailed flowchart according to the embodiment.

FIG. 3 shows a detailed flowchart for operation of the controller 15 according to this embodiment. This operation is executed adopting, as the time of initially outputting the synchronization pulse as a substitute for the input synchronization signal, the time toggled between the Min value and the Max value according to the length of the period, and adopting, as the time of outputting the synchronization pulse in succession because of impossibility of recovery from the synchronization pulse to the input synchronization signal, the time when the period always becomes the Max value.

The synchronization signal is input into the controller 15 (S201). Then, the counter 15*a* provided in the controller 15 counts the period of the synchronization signal. In other words, the number of vertical lines CntLine1 and the number of horizontal pixels CntDot1 are detected (S202).

After detecting the period, i.e. the numbers of the horizontal pixels and the vertical lines, the comparator 15*b* compares magnitudes between the count value and the minimum value Min (S203). As described above, the minimum value Min for the number of the horizontal pixels is 1050, for example, and the minimum value Min for the number of vertical lines is 780, for example. When the count value is equal to or greater than the minimum value Min, the comparator 15*b* subsequently compares magnitudes between the count value and the maximum value Max (S204). The maximum value for the number of horizontal pixels is 1800, for example, and the maximum value Max for the number of vertical lines is 900, for example.

If, as a result of the comparison in the comparator 15*b*, the count value is found to be within the range between the minimum value Min and the maximum value Max, "NO" is determined in both step S203 and step S204, and as a result the input synchronization signal is output without change (S205). Subsequently, the period of the synchronization signal is counted again and compared in the comparator 15*b*.

On the other hand, when the count value is judged as being smaller than the minimum value Min in step S203, the synchronization pulse generator 15*c* generates the synchronization pulse (or the free-running pulse) at the time when the period becomes the minimum value Min (S206). Alternatively, when the count value is judged as being greater than the maximum value Max in step S204, the synchronization pulse generator 15*c* generates the synchronization pulse (or the free-running pulse) at the time when the period becomes the maximum value Max (S207). After generating the synchronization pulse according to the magnitude of the period, the synchronization pulse is output by the selector 15*e* (S208).

Subsequent to output of the synchronization pulse (or the free-running pulse), the counter 15*a* resumes its count operation to count the period until a new synchronization signal is input. The count value obtained at this time is taken as the number of vertical lines CntLine2 and the number of horizontal pixels CntDot2 (S209). Then, the comparator 15*b* compares magnitudes between the count value and the minimum Min or the maximum value Max again. More specifically, the count value is first compared with the minimum value Min (S210), and then compared with the maximum value Max if the count value is equal to or greater than the minimum value Min (S211). When "NO" is determined in both step S210 and step S211, i.e. the period from output of the synchronization pulse to next input of the synchronization signal is within the range between the minimum value Min and the maximum value Max, it is possible to return to the synchronization signal. Therefore, generation and output of a synchronization pulse in the synchronization pulse generator 15*c* is terminated (which is refereed to as an off state of free-running mode) (S212), and the selector 15*e* outputs the synchronization signal having been input (S213).

On the other hand, when "YES" is determined either in step S210 or step S211, i.e. the period from output of the synchronization pulse to next input of the synchronization signal is smaller than the minimum value Min or greater than the maximum value Max, returning to the synchronization signal causes the period to go out of the predetermined range, which might introduce burning of the LCD panel. Therefore, the free-running mode is maintained. In other words, the synchronization pulse generator 15*c* continues generation of the synchronization pulse and the selector 15*e* outputs the synchronization pulse. Then, the synchronization pulse generator 15*b* generates and outputs the synchronization pulse at the timing that the period always becomes the Max value regardless of the magnitude of the period (S214).

The number of times that the synchronization pulse is generated and output by the synchronization pulse generator 15*c* is counted by the counter 15*d*. When the number of times reaches three, more specifically, when a state in which the count value CntLine1 or CntDot1 of the input synchronization signal is substantially equal to the Max value occurs in three successive fields, the timing of generation and output of the synchronization pulse in free-running mode is changed from the timing of the Max value to the timing of the Min value (S216). When the Max value is almost equal to CntLine1 or CntDot1, the period from generation of the synchronization pulse to the next input of the synchronization signal is kept constant and remains out of the predetermined range even though the input synchronization signal has the normal period, which develops a situation where the free-running mode is maintained with the result that returning to the synchronization signal is disabled. In view of the above situation, by shifting the timing of generating and outputting the synchronization pulse from the Max value to the Min value, the period between the synchronization pulse and next input of the synchronization signal is changed so as to be within the predetermined range. In this manner, returning to the synchronization signal is facilitated. Subsequent to shifting the timing from the Max value to the Min value, the period is counted (S209). Then, when the period is judged to be within the predetermined range (NO is determined in steps S201 and S11), the free-running mode is turned Off (S212) to return to the synchronization signal (S213).

Figure 4:
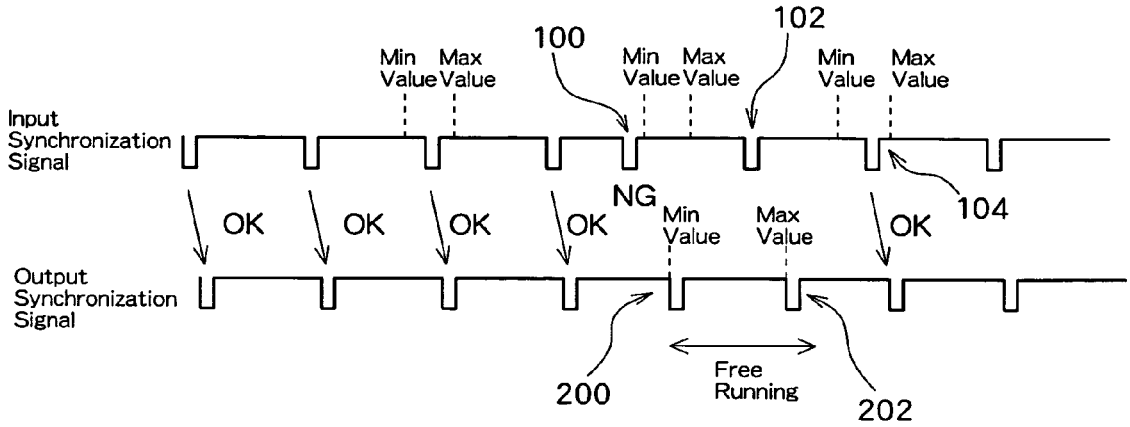
FIG. 4 shows a timing chart (of part 1) according to the embodiment.

FIG. 4 shows a timing chart for the synchronization signal to be output according to the above-described process. In FIG. 4, a timing chart for the input synchronization signal is shown along with a timing chart for the output synchronization signal to be output in response to the input synchronization signal. When the period of the input synchronization signal is within the range between the minimum value Min and the maximum value Max, the controller 15 outputs the input synchronization signal without change. In FIG. 4, the synchronization signal to be output from the controller 15 without being processed is indicated with "OK". On the other hand, an input synchronization signal 100 having a period smaller than the minimum value Min is indicated with "NG" representing an out-of-range state. Such an irregular period could be introduced by channel tuning, rewinding or fast forwarding of a VTR, etc. At the occurrence of the irregular period, the controller 15 outputs the synchronization pulse generated by the synchronization pulse generator 15*c* provided in the controller 15 as a substitute for the input synchronization signal 100. Output of the synchronization pulse is executed at the time when the period becomes the minimum value Min. In the figure, the output is indicated as a synchronization pulse 200.

After generating and outputting the synchronization pulse 200, a new synchronization signal 102 is input. However, because the period relative to the synchronization pulse is smaller than the minimum value Min, the input synchronization signal 102 cannot be output without change. Therefore, the controller 15 maintains the free-running mode to output the synchronization pulse generated by the synchronization pulse generator 15*c* in the controller 15. This synchronization pulse is indicated as a synchronization pulse 202 in FIG. 4, and output of the synchronization pulse 202 is executed at the time when the period from the synchronization pulse 200 becomes the maximum value Max.

After generation and output of the synchronization pulse 202, a new synchronization signal 104 is input. Because the period between the synchronization pulse 202 and the input synchronization signal 104 lies between the minimum value Min and the maximum value Max, the synchronization signal 104 is judged as "OK". According to this judgment, the controller 15 turns the free-running mode off and outputs the input synchronization signal 104 without change. In this manner, the synchronization signal is finally output. This synchronization signal to be output has a normal period within the range between the minimum value Min and the maximum value Max.

In the timing chart of FIG. 4, after the free-running mode is turned on and the synchronization pulses 200 and 202 are generated and output, the free-running mode is turned off to return to the input synchronization signal. However, depending on the timing of input of the input synchronization signal 104, the period from output of the synchronization pulse 202 remains out of the range, which results in the fact that the synchronization pulse generator 15*c* will generate and output another synchronization pulse. If the free-running mode is successively repeated the predetermined number of times, the timing of outputting the synchronization pulse is changed from the Max value to the Min value in an attempt to recover from the free-running mode.

Figure 5:
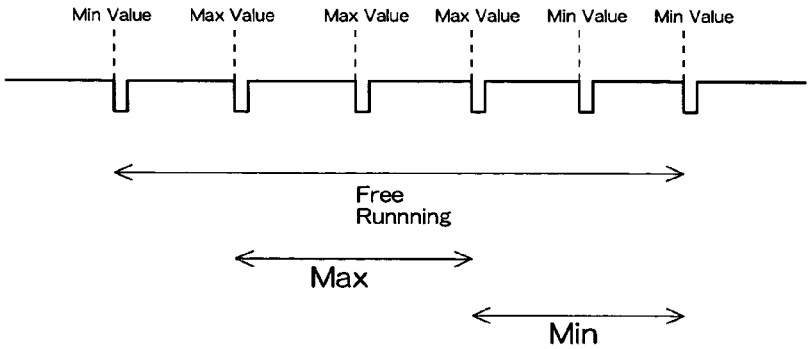
FIG. 5 shows an explanatory drawing for changing the time of outputting a synchronization pulse according to the embodiment.

FIG. 5 schematically shows shifting of output timing of a synchronization pulse. In FIG. 5, because the period of the synchronization signal is smaller than the minimum value Min, the free-running mode is turned on, and the synchronization pulse is output at the time when the period becomes the minimum value Min. After that, the synchronization pulse is sequentially output from the synchronization pulse generator 15*c* at the time when the period becomes the maximum value Max. If the output at that time is successively repeated three times (in three fields), the timing of outputting the synchronization pulse is changed from the Max value to the Min value. The change from the Max value to the Min value is executed according to a shifting signal from the counter 15*d* as shown in FIG. 1. By executing output at the timing of the Min value, the period between the synchronization pulse and the input synchronization signal is changed so that rapid recovery to the input synchronization signal is attempted. More specifically, even though the period of the input synchronization signal itself is normal, by fixing the timing of outputting the synchronization pulse, the period between the synchronization pulse and the input synchronization signal is also fixed, which results in the period always remaining out of the range. If the output timing of the synchronization pulse is changed to the Min value, the period between the synchronization pulse and the input synchronization signal is changed (increased), which results in the period falling within the range and thereby an attempt to recover to the input synchronization signal is made.

Figure 6:
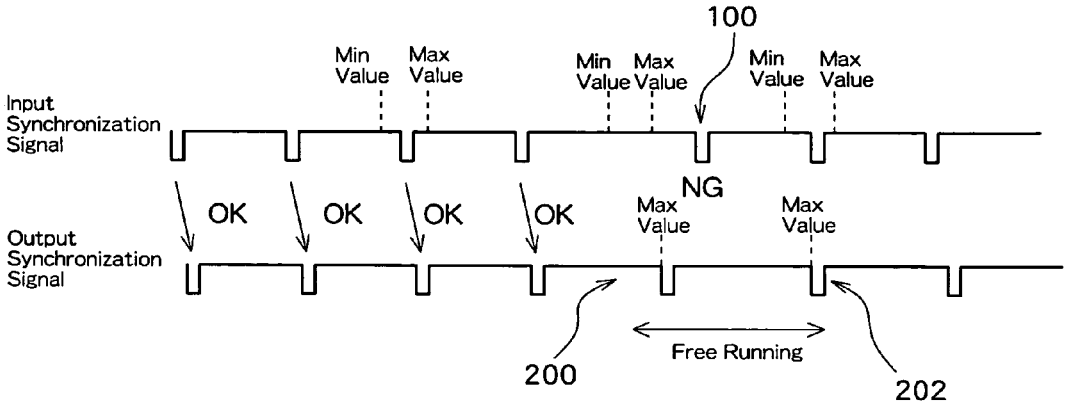
FIG. 6 shows the timing chart (of part 2) according to the embodiment.

FIG. 6 shows a timing chart in a case where the period of the input synchronization signal exceeds the maximum value Max. When the period of the input synchronization signal exceeds the maximum value Max, i.e. when a synchronization signal is not input at the maximum value Max, the synchronization pulse generator 15*c* inside the controller 15 generates and outputs the synchronization pulse 200 at the time when the period becomes the maximum value Max. The free-running mode is turned off to return to the input synchronization signal if the period between the synchronization pulse 200 and the input synchronization signal is within the range, similarly to the example of FIG. 4, whereas the synchronization pulse 202 is output if the period between the synchronization pulse 200 and the input synchronization signal is out of the range.

As described above, according to this embodiment, the input synchronization signal is output without being processed when the period of the input synchronization signal, i.e. the number of horizontal pixels and the number of vertical lines are within the range between the predetermined Min and Max values. On the other hand, when the period is not within the range, a synchronization pulse is generated in the controller 15 to maintain the input synchronization signal within the predetermined range. In addition to generation of the synchronization pulse, the period is adjusted to be within the range also at the time of returning to the input synchronization signal. In this manner, burning of the LCD panel can be prevented.

It should be noted that this invention is not limited to the above-described embodiment and may be changed or modified in various ways.

In the above embodiment, the synchronization pulse is output at the timing of the Min value when the period of the input synchronization signal is smaller than the Min value, or the synchronization pulse is output at the timing of the Max value when the period of the input synchronization signal is larger than the Max value, and then the free-running mode is initiated. Further, the synchronization pulse is output at the timing of the Max value when the free-running mode is activated. However, the synchronization pulse may be output, for example, always at the timing of the Max value when the period of the input synchronization signal is out of the range and output at the timing of the Max value also in the free-running mode.

Figure 7:
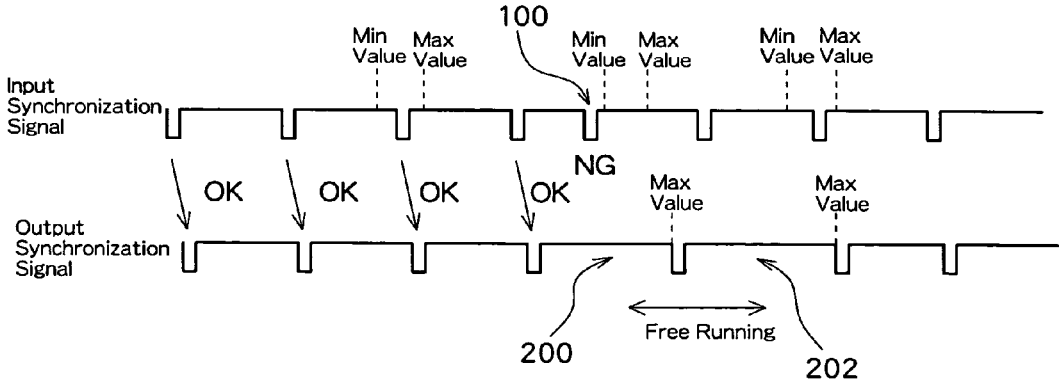
FIG. 7 shows another timing chart according to the embodiment.

FIG. 7 shows a timing chart for the synchronization signal in the above case. When the period of the input synchronization signal 100 is smaller than the Min value, the synchronization pulse generator 15*c* provided inside the controller 15 generates and outputs the synchronization pulse 200 at the time when the period becomes the Max value. In the free-running mode subsequent to the generation and output, similarly to the case of FIG. 4, the synchronization pulse generator 15*c* outputs the synchronization pulse 202 at the time when the period becomes the Max value, and then tries to recover the input synchronization signal by shifting the output timing to the timing of the Min value.

Although, in the free-running mode, the synchronization pulse is always generated and output at the time when the period becomes the Max value whenever the period between the synchronization pulse and the input synchronization signal is out of the range, the synchronization pulse may be generated and output at the time when the period becomes the Min value even in the free-running mode if the period goes out of range because the period between the synchronization pulse and the input synchronization signal is smaller than the Min value, and generated at the time when the period becomes the Max value if the period goes out of range because the period exceeds the maximum value Max. In this case, after generating the synchronization pulse at the timing of the Min value in the case where yes is determined in S210 of the flowchart shown in FIG. 3, or at the timing of the Max value in the case where yes is determined in S211, operation proceeds to step S215.

Further, in this embodiment, the synchronization pulse is generated and output at the time when the period becomes the Min value when the period of the input synchronization signal is smaller than the Min value. However, the synchronization pulse may be generated and output at a time midway between the Min value and the Max value, or may be generated and output at an arbitrary time between the Min and Max values when the period of the input synchronization signal is smaller than the Min value. The same can be applied to generation and output in the free-running mode.

This embodiment may be applied to at least either of the horizontal synchronization signal and the vertical synchronization signal. More specifically, the circuit illustrated in FIG. 1 may be applied only to a horizontal synchronization signal system, or may be applied only to a vertical synchronization signal system. Alternatively, the circuit may be applied to both of the horizontal and vertical synchronization signal systems.

What is claimed is:

1. A liquid crystal display controller controlling a screen in synchronism with a synchronization signal comprising:

an input section for inputting the synchronization signal, and a synchronization pulse signal generator which judges whether or not a period of an input synchronization signal is within a range between a predetermined minimum and maximum values, generates a synchronization pulse signal, when the period of the input synchronization signal is not within the range, at a time when the period falls within the range, then outputs the synchronization pulse signal as a substitute for the input synchronization signal, and further generates and outputs the synchronization pulse signal, when a period between generation of the synchronization pulse signal and new input of the input synchronization signal is not within the range, at a time identical to or different from the time of the initial generation.

2. The controller according to claim 1, wherein the synchronization pulse signal generator generates and outputs the synchronization pulse signal, when the period is not within the range, at a time when the period becomes the maximum value, and further generates and outputs the synchronization pulse signal, when the period between the generated and output synchronization pulse signal and new input of the input synchronization signal is not within the range, at the time when the period becomes the maximum value.

3. The controller according to claim 1, wherein the synchronization pulse signal generator generates and outputs the synchronization pulse signal, when the period of the input synchronization signal is smaller than the minimum value, thereby going out of the range, at the time when the period becomes the minimum value, or when the period of the input synchronization signal is greater than the maximum value, thereby going out of the range, at the time when the period becomes the maximum value, and further generates and outputs the synchronization pulse signal again, when the period between the generated and output synchronization pulse signal and new input of the input synchronization signal is not within the range, at the time when the period becomes the maximum value.

4. The controller according to claim 2, wherein when the number of times that the synchronization pulse signal is successively generated and output at the time when the period between the generated synchronization pulse signal and new input of the input synchronization signal becomes the maximum value reaches a predetermined value, the synchronization pulse signal generator generates and outputs the synchronization pulse signal after changing the time to the time when the period becomes the minimum value.

5. The controller according to claim 3, wherein when the number of times that the synchronization pulse signal is successively generated and output at the time when the period between the generated synchronization pulse signal and new input of the input synchronization signal reaches a predetermined value, the synchronization pulse signal generator generates and outputs the synchronization pulse signal after changing the time to the time when the period becomes the minimum value.

6. The controller according to claim 1, wherein the synchronization pulse signal generator generates and outputs the synchronization pulse signal, when the period of the input synchronization signal is smaller than the minimum value, thereby going out of the range, at the time when the period becomes the minimum value, or when the period of the input synchronization signal is greater than the maximum value, thereby going out of the range, at the time when the period becomes the maximum value, and further generates and outputs the synchronization pulse signal again, when the period between the generated and output synchronization pulse signal and new input of the input synchronization signal is smaller than the minimum value, thereby going out of the range, at the time when the period becomes the minimum value, or when the period between the generated and output synchronization pulse signal and new input of the input synchronization signal is greater than the maximum value, thereby going out of the range, at the time when the period becomes the maximum value.

7. The controller according to claim 1, wherein the synchronization signal is at least either of a horizontal synchronization signal and a vertical synchronization signal.

8. A liquid crystal display controller controlling a screen in synchronism with a synchronization signal comprising:

a first counter which counts a period of the synchronization signal being input;

a comparator which compares a count value of the first counter with a predetermined minimum value or a predetermined maximum value;

a synchronization pulse generator which outputs a synchronization pulse signal, when the count value is smaller than the minimum value or greater than the maximum value, independently of the synchronization signal being input, and a selector to which the synchronization signal is input and the synchronization pulse signal output from the synchronization pulse generator are input, the selector selectively outputting the synchronization signal being input when the count value is greater then or equal to the minimum value and smaller than or equal to the maximum value, or selectively outputting the synchronization pulse signal output from the synchronization pulse generator when the count value is smaller than the minimum value or greater than the maximum value.

9. The controller according to claim 8 further comprising a second counter which counts, when the synchronization pulse signal is output from the synchronization pulse generator, a period between the synchronization pulse signal and the synchronization signal to be input subsequent to the synchronization pulse signal, wherein the comparator compares a count value of the second counter with the predetermined minimum value and the predetermined maximum value, the synchronization pulse generator continues to output the synchronization pulse signal when the count value of the second counter is smaller than the minimum value or greater than the maximum value, and the selector selectively outputs, when the count value of the second counter is greater than or equal to the minimum value and smaller than or equal to the maximum value, the input synchronization signal being input, or selectively outputs, when the count value of the second counter is smaller than the minimum value or greater than the maximum value, the synchronization pulse signal from the synchronization pulse generator in succession.

10. The controller according to claim 9, wherein the synchronization pulse generator outputs the synchronization pulse signal at a timing equal to the maximum value when the count value of the first counter or the count value of the second counter is smaller than the minimum value or greater than the maximum value.

11. The controller according to claim 9, wherein the synchronization pulse generator outputs the synchronization pulse signal, when the count value of the first counter or the count value of the second counter is smaller than the minimum value, at the timing equal to the minimum value, or outputs the synchronization pulse signal, when the count value of the first or the second counter is greater than the maximum value, at the timing equal to the maximum value.

12. The controller according to claim 9, wherein the synchronization pulse generator outputs the synchronization pulse signal, when the count value of the first counter is smaller than the minimum value, at the timing equal to the minimum value or when the count value is greater than the maximum value, at the timing equal to the maximum value, and outputs the synchronization pulse, when the count value of the second counter is smaller than the minimum value or greater than the maximum value, at the timing equal to the maximum value.

13. The controller according to claim 9, further comprising:

a third counter which counts the number of pulses of the synchronization pulse signal generated in the synchronization pulse generator, wherein the synchronization pulse generator changes the timing of outputting the synchronization pulse signal when a count value of the third counter reaches a predetermined value.

14. The controller according to claim 13, wherein the synchronization pulse generator outputs the synchronization pulse signal at the timing equal to the maximum value when the count value of the first or second counter is smaller than the minimum value or greater than the maximum value, and outputs the synchronization pulse signal after changing the timing to the timing equal to the minimum value when the count value of he third counter reaches the predetermined value.

15. The controller according to claim 13, wherein when the count value of the first counter or the count value of the second counter is smaller than the minimum value, the synchronization pulse generator outputs the synchronization pulse signal at the timing equal to the minimum value, or when the count value is greater than the maximum value, the synchronization pulse generator outputs the synchronization pulse signal at the timing equal to the maximum value in addition to outputting the synchronization pulse signal after changing the timing to the timing equal to the minimum value when the count value of the third counter reaches the predetermined value.

16. The controller according to claim 8, wherein the synchronization signal is at least either of a horizontal synchronization signal and a vertical synchronization signal.

17. The controller according to claim 8, wherein the minimum value and the maximum value are established according to resolution of the screen.

* * * * *

UNITED STATES PATENT AND TRADEMARK OFFICE

CERTIFICATE OF CORRECTION

PATENT NO. : 7,312,793 B2
APPLICATION NO. : 10/933781
DATED : December 25, 2007
INVENTOR(S) : Kazunori Chida It is certified that error appears in the above-identified patent and that said Letters Patent is hereby corrected as shown below:

In Claim 14, column 16, line 8, the word "he" should be --the--.

Signed and Sealed this

Thirteenth Day of May, 2008

JON W. DUDAS
*Director of the United States Patent and Trademark Office*